United States Patent [19]

Reinke

[11] Patent Number: 5,038,943

[45] Date of Patent: Aug. 13, 1991

[54] COLLAPSIBLE DISPLAY RACK

[76] Inventor: Arthur J. Reinke, P.O. Box 20310, Salem, Oreg. 97307

[21] Appl. No.: 554,377

[22] Filed: Jul. 19, 1990

[51] Int. Cl.[5] ..... A47F 5/00

[52] U.S. Cl. ..... 211/59.1; 211/181; 211/195; 248/222.2; 248/175

[58] Field of Search ..... 211/181, 195, 59.1, 211/106, 57.1; 248/220.2, 214, 215, 222.2, 463, 465, 465.1, 27.8, 175, 166

[56] References Cited

U.S. PATENT DOCUMENTS

| | | | |
|---|---|---|---|
| 537,578 | 4/1895 | McMichael | 248/465 |
| 815,480 | 3/1906 | Silven | 248/465.1 X |
| 1,258,049 | 3/1918 | Sanborn | 248/175 X |
| 1,659,871 | 2/1928 | Hartman | 248/465 |
| 4,501,369 | 2/1985 | Fox | 211/59.1 X |
| 4,832,298 | 5/1989 | Metcalf | 248/222.2 |
| 4,842,230 | 6/1989 | Cobb et al. | 211/181 X |
| 4,884,202 | 12/1989 | Rebow | 211/106 X |

FOREIGN PATENT DOCUMENTS

| | | | |
|---|---|---|---|
| 1478879 | 3/1967 | France | 211/106 |
| 2405049 | 6/1979 | France | 211/59.1 |
| 1230856 | 5/1971 | United Kingdom | 211/106 |

*Primary Examiner*—Robert W. Gibson, Jr.
*Attorney, Agent, or Firm*—Eugene D. Farley

[57] ABSTRACT

A collapsible display rack designed particularly for mounting floral displays. The rack comprises a looped rod base frame mounting a grid of spaced, horizontally arranged wire-like elements secured across its face. A collapsible, bracketed standard supports the grid. A plurality of hooks, and a trough for holding tools and supplies are demountably mountable on selected components of the grid in desired locations.

6 Claims, 1 Drawing Sheet

COLLAPSIBLE DISPLAY RACK

This invention relates to collapsible display racks of the class designed particularly for mounting floral displays.

BACKGROUND AND GENERAL STATEMENT OF THE INVENTION

It is the general purpose of the present invention to provide a display rack, particularly a floral display rack, which is versatile in its application. Thus it may be used to display to advantage floral pieces and accessories of various categories, sizes and shapes. It also may be used as an easel for holding delicate floral components to be used in making floral arrangements of various kinds.

It is a further object of the present invention to provide a display rack, particularly a floral display rack, which provides display faces arranged in two or three planes, thereby greatly increasing its capacity and effectiveness.

Still a further object of the present invention is the provision of a display rack, particularly a floral display rack, which is easily collapsible for storage and which is easily adjusted to a stable, operating position.

Another object of the present invention is the provision of a display rack, particularly a floral display rack, provided with a plurality of demountable support hooks and a demountable trough for accessories and tools, which may be arranged at will in a variety of effective operating positions.

The foregoing and other objects of the present invention are accomplished by means of a display rack structure which, basically considered, comprises a looped rod base frame mounting a grid of spaced, horizontally arranged wire-like elements secured across its face. A collapsible, bracketed standard supports the grid. A plurality of hooks, and a trough for holding tools and supplies are demountably mountable on selected components of the grid in desired locations.

Considering the foregoing in greater detail and in conjunction with the drawings:

THE DRAWINGS

DESCRIPTION OF A PREFERRED EMBODIMENT OF THE INVENTION

Figure 2:
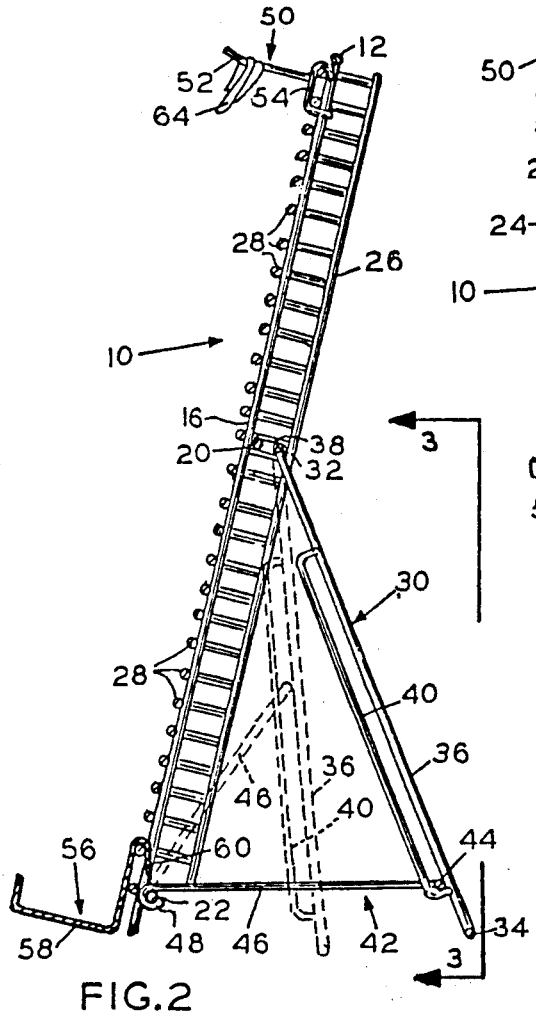
FIG. 2 is a sectional view of the rack taken along line 2—2 of FIG. 1, with the rack in its erected, operational mode.
Figure 1:
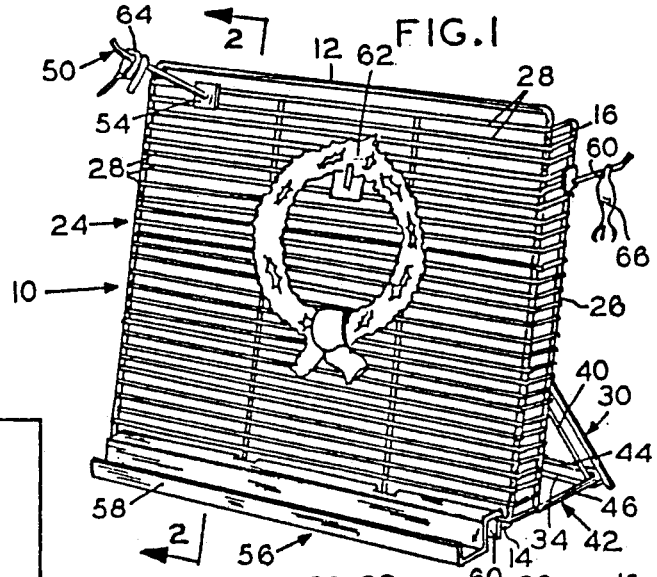
FIG. 1 is a front perspective view of the herein described collapsible display rack.

As shown particularly in FIGS. 1 and 2, the elements of the display rack of my invention are supported on a looped rod of substantial strength providing a base frame indicated generally at 10. The base frame preferably is rectangular in contour and includes a top segment 12, a bottom segment 14, and two side segments 16.

Bottom segment 14 provides a base on which the rack assembly is supported in part.

An upper horizontal support bar 20 is mounted across the back of the base frame between side segments 16. It is located centrally at an elevation which is slightly above the vertical mid-point of the side segments.

A lower support bar 22 spans side segments 16 at near the bottom of the frame.

A grid having for its purpose the mounting in varied arrangement of floral and other displays is indicated generally at 24. It is attached by welding or otherwise to the front face of base frame 10. It comprises a pair of grid frame members 26 which mount a plurality of vertically spaced, horizontally arranged, wire-like elements 28.

Elements 28 preferably are bent at right angles near their terminal portions to provide a 3-sided structure which in effect partially wraps around base frame 10 in the manner illustrated particularly in FIG. 1. This provides three faces, a front face and two side faces, for purposes of display, thereby greatly increasing the effectiveness of the rack in achieving its desired functions.

Further support for the rack is provided by means of a standard indicated generally at 30.

Standard 30 comprises a looped or U-shaped rod component having a top segment 32, a bottom segment 34, and a pair of side segments 36. Bottom segment 34 cooperates with bottom frame segment 14 in providing bearing support for the rack assembly.

To render the rack fully collapsible and adjustable between an expanded use position and a collapsed storage position, top segment 32 of standard 30 is hinged to upper support bar 20 by means of hinges 38. Also, it is provided on side segments 36 with longitudinally extending slide and guide elements 40.

Bracket means indicated generally at 42 are provided for adjustably maintaining standard 30 in its extended, operative position of FIG. 2.

Figure 3:
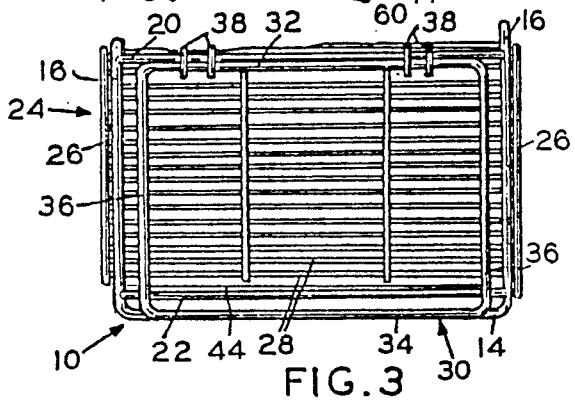
FIG. 3 is a fragmentary, rear elevational view of the rack, looking in the direction of the arrows of line 3—3 of FIG. 2.

As shown particularly in FIGS. 2 and 3, the bracket means comprises a U-shaped member made preferably of a metal rod bent to provide a bracket bottom segment 44 and a pair of side segments 46.

Bottom segment 44 is received in elements 40 on standard 30 in slide-and-guide arrangement. The terminal portions of bracket side segments 46 are reversely bent to provide hinge knuckles 48 which hinge the inner ends of the bracket to lower support bar 22.

Figure 4:
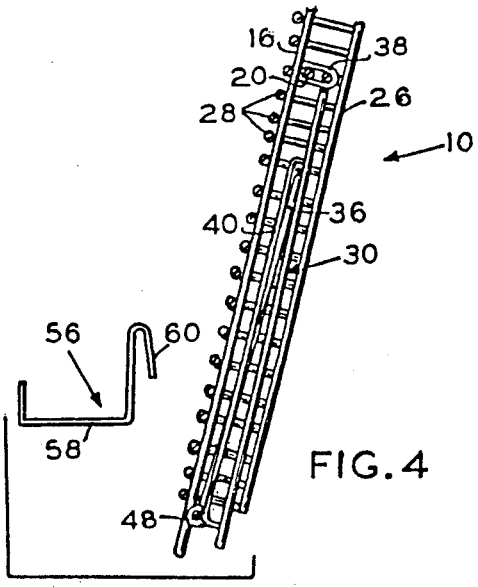
FIG. 4 is a fragmentary side view of the display rack in its collapsed, storage mode.

The assembly accordingly can shift from a past-dead-center, opened out, full line position of FIG. 2, to the dashed line intermediate position of that figure, and then to the fully collapsed position of FIG. 4.

The rack assembly thus provided affords support for one or more hook subassemblies on which display items may be supported, and a trough subassembly for containing implements and supplies.

Figure 5:
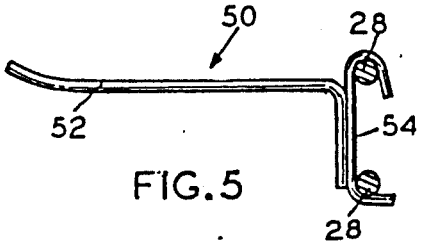
FIG. 5 is an enlarged, detailed, fragmentary view illustrating the construction of a support hook for use together with the display rack of the invention, and the manner of its demountable mounting on the rack components.

An exemplary hook subassembly, indicated generally at 50, is illustrated in FIG. 5. It comprises a hook segment 52 welded or otherwise secured to a clamping base segment 54. The latter is so dimensioned and arranged that it can be hooked over and clamped between any selected pair of grid wires 28. This makes possible mounting a display in any selected position on any one of the three display faces of the grid.

The trough subassembly, indicated generally at 56, comprises a trough 58 and a reversely bent hook 60. These two components preferably are formed integrally from a single piece of material such as molded plastic.

Trough support hook 60 and trough 58 are dimensioned and contoured in such a manner that when hook 60 is hooked over a selected one of grid wires 28, the inner side wall of trough 58 will bear against the immediately adjacent grid wire to support the trough in operative position.

OPERATION

In use, the rack first is adjusted from its collapsed, storage position of FIG. 4 to its expanded, operative position of FIG. 2. In this position it is stabilized by standard 30 releasably locked in its extended position by bracket 42, which is in an over-dead-center position.

Trough 56 then is mounted in its desired location, usually at the bottom of the rack.

Depending upon the items to be displayed, for example wreath 62, ribbon 64, and ornament 66, hooks 50 are mounted on the grid in the desired pattern.

The rack thus may be used either for display purposes or as an easel for the purpose of making floral arrangements. In the latter application, containers containing floral items to be arranged may be supported on hooks 52.

The rack assembly accordingly is characterized by great versatility and stability in use. When not used, it may be collapsed for storage to the position of FIG. 4.

Having thus described in detail a preferred embodiment of the present invention, it will be apparent to those skilled in the art that many physical changes may be made in the apparatus without altering the inventive concepts and principles embodied therein. The present embodiment is therefore to be considered in all respects as illustrative and not restrictive, the scope of the invention being indicated by the appended claims.

I claim:

1. A collapsible display rack comprising:

a) a looped rod base frame having a face, a back, a top, a bottom and two sides, b) a grid of spaced, horizontally arranged wire-like elements secured across the face of the base frame, c) an upper horizontal support bar centrally mounted across the sides of the base frame, d) a lower horizontal support bar mounted across the sides of the base frame, adjacent its base, e) a standard having top, bottom and side segments, f) hinge means hinging the top segment of the standard to the upper support bar, g) slide and guide means mounted on the side segments of the standard, longitudinally thereof, h) at least one bracket means having inner and outer ends, the inner end being operatively received in the slide and guide means; and i) second hinge means hinging the outer end of the bracket means to the lower support bar.

2. The display rack of claim 1 wherein the grid is dimensioned to extend beyond the sides of the base frame and bent to wrap around the same, thereby providing a grid face segment and at least one communicating side segment.

3. The display rack of claim 1 in combination with a plurality of hooks, each hook including an outwardly extending hook finger, a base, and mounting means releasably mounting the base on selected ones of the wire like elements of the grid.

4. The display rack of claim 3 wherein the mounting means comprises friction clamp mounting means.

5. The display rack of claim 1 in combination with a horizontally arranged trough and trough mounting means releasably securing the trough to the grid wire like elements.

6. The display rack of claim 5 wherein the trough mounting means comprises hook means contoured and dimensioned to hook over a selected one of said grid wire like elements.

* * * * *